US010604947B2

(12) United States Patent
Cook et al.

(10) Patent No.: US 10,604,947 B2
(45) Date of Patent: Mar. 31, 2020

(54) LOOSEFILL INSULATION BLOWING MACHINE

(71) Applicant: Owens Corning Intellectual Capital, LLC, Toledo, OH (US)

(72) Inventors: David M. Cook, Granville, OH (US); Christopher M. Relyea, Marysville, OH (US); Brandon Robinson, Sylvania, OH (US)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 293 days.

(21) Appl. No.: 15/267,182

(22) Filed: Sep. 16, 2016

(65) Prior Publication Data

US 2017/0073982 A1 Mar. 16, 2017

Related U.S. Application Data

(60) Provisional application No. 62/219,418, filed on Sep. 16, 2015.

(51) Int. Cl.

| | |
|---|---|
| ***E04F 21/08*** | (2006.01) |
| ***B02C 18/22*** | (2006.01) |
| ***B02C 23/20*** | (2006.01) |
| ***B02C 18/08*** | (2006.01) |

(52) U.S. Cl.

CPC ..... *E04F 21/085* (2013.01); *B02C 18/08* (2013.01); *B02C 18/22* (2013.01); *B02C 18/2216* (2013.01); *B02C 18/2291* (2013.01); *B02C 23/20* (2013.01)

(58) Field of Classification Search

CPC ..... B02C 23/20; B02C 18/08; B02C 18/22
USPC ..... 241/60, 605
See application file for complete search history.

(56) References Cited

U.S. PATENT DOCUMENTS

| | | | |
|---|---|---|---|
| 2,291,871 | A | 8/1942 | Bokum et al. |
| 2,311,773 | A | 2/1943 | Patterson |
| 2,532,318 | A | 12/1950 | Mackey et al. |
| 2,550,354 | A | 4/1951 | Jacobsen |
| 2,721,767 | A | 10/1955 | Kropp |
| 2,869,793 | A | 1/1959 | Montgomery |
| 2,989,252 | A | 6/1961 | Babb |
| 3,061,206 | A | 10/1962 | Matter |

(Continued)

*Primary Examiner* — Shelley M Self
*Assistant Examiner* — Jared O Brown
(74) *Attorney, Agent, or Firm* — MacMillan, Sobanski & Todd, LLC

(57) ABSTRACT

A machine for distributing loosefill insulation material. The machine includes a chute having an inlet end and an outlet end. The inlet end is configured to receive loosefill insulation material. The chute has a first portion in fluid communication with a second portion and forms an angle with the second portion. A shredding chamber includes a plurality of shredders configured to shred, pick apart and condition the loosefill insulation material. A discharge mechanism is mounted to receive the loosefill insulation material exiting the shredding chamber. The discharge mechanism is configured to distribute the loosefill insulation material into an airstream. A blower is configured to provide the airstream flowing through the discharge mechanism. The angle between the first portion of the chute and the second portion of the chute is configured to control the descent of the loosefill insulation material into the shredding chamber.

3 Claims, 10 Drawing Sheets

(56) References Cited

U.S. PATENT DOCUMENTS 3,175,866 A 3/1965 Nichol
3,314,732 A 4/1967 Hagan et al.
3,329,160 A 7/1967 Tantlinger et al.
3,529,870 A 9/1970 Woten
3,556,355 A 1/1971 Ruiz
3,861,599 A 1/1975 Waggoner
3,977,705 A * 8/1976 Thiessen ..... F16L 17/073 285/112
3,995,775 A 12/1976 Birkmeier et al.
4,134,242 A 1/1979 Musz et al.
4,161,296 A * 7/1979 Parker ..... B02C 18/148 241/152.2
4,236,654 A 12/1980 Mello
4,273,296 A 6/1981 Hoshall
4,337,902 A 7/1982 Markham
4,344,580 A 8/1982 Hoshall et al.
4,385,477 A 5/1983 Walls et al.
4,411,390 A 10/1983 Woten
4,465,239 A 8/1984 Woten
4,560,307 A 12/1985 Deitesfeld
4,829,738 A 5/1989 Moss
4,978,252 A 12/1990 Sperber
5,131,590 A * 7/1992 Sperber ..... B28C 5/026 239/427.5
5,285,973 A 2/1994 Goforth et al.
5,355,653 A 10/1994 Henri
5,379,568 A 1/1995 Murray
5,462,238 A 10/1995 Smith et al.
5,511,730 A * 4/1996 Miller ..... B02C 18/12 241/101.4
5,639,033 A * 6/1997 Miller ..... B02C 18/12 241/101.4
5,647,696 A 7/1997 Sperber
5,669,563 A 9/1997 Gearing et al.
5,829,649 A 11/1998 Horton
5,860,606 A 1/1999 Tiedeman et al.
5,947,646 A 9/1999 Lytle
5,984,590 A 11/1999 Church, II et al.
6,045,298 A 4/2000 Lytle
6,109,488 A 8/2000 Horton
6,401,757 B1 6/2002 Pentz et al.
6,503,026 B1 1/2003 Mitchell
6,648,022 B2 11/2003 Pentz et al.
7,263,810 B1 9/2007 Trauba
7,475,830 B2 1/2009 Fellinger
7,819,349 B2 10/2010 Johnson et al.
7,878,435 B2 2/2011 Johnson et al.
7,887,662 B2 2/2011 Wagner et al.
7,938,348 B2 5/2011 Evans et al.
7,971,813 B2 7/2011 O'Leary et al.
7,980,498 B2 7/2011 Johnson et al.
8,141,222 B2 3/2012 Evans et al.
8,191,809 B2 6/2012 Johnson et al.
8,245,960 B2 8/2012 Johnson et al.
8,272,587 B2 9/2012 Johnson et al.
8,680,168 B2 3/2014 Fishback et al.
8,726,608 B2 5/2014 O'Leary et al.
2005/0132531 A1 6/2005 Haberlein
2005/0230928 A1* 10/2005 Raney ..... B62B 1/002 280/19.1
2008/0173737 A1* 7/2008 Evans ..... E04F 21/085 239/698
2010/0230522 A1* 9/2010 Johnson ..... E04F 21/085 241/60
2011/0146176 A1* 6/2011 O'Leary ..... E04B 1/7604 52/309.1
2013/0277507 A1 10/2013 Stevens
2014/0041203 A1* 2/2014 Buchanan ..... F16L 21/007 29/525.02
2015/0060583 A1* 3/2015 Boehlefeld ..... B02C 18/142 241/167

* cited by examiner

LOOSEFILL INSULATION BLOWING MACHINE

BACKGROUND

When insulating buildings and installations, a frequently used insulation product is loosefill insulation material. In contrast to the unitary or monolithic structure of insulation materials formed as batts or blankets, loosefill insulation material is a multiplicity of discrete, individual tufts, cubes, flakes or nodules. Loosefill insulation material is usually applied within buildings and installations by blowing the loosefill insulation material into an insulation cavity, such as a wall cavity or an attic of a building. Typically loosefill insulation material is made of glass fibers although other mineral fibers, organic fibers, and cellulose fibers can be used.

Loosefill insulation material, also referred to as blowing wool, is typically compressed in packages for transport from an insulation manufacturing site to a building that is to be insulated. Typically the packages include compressed loosefill insulation material encapsulated in a bag. The bags can be made of polypropylene or other suitable material. During the packaging of the loosefill insulation material, it is placed under compression for storage and transportation efficiencies. Typically, the loosefill insulation material is packaged with a compression ratio of at least about 10:1.

The distribution of loosefill insulation material into an insulation cavity typically uses an insulation blowing machine that conditions the loosefill insulation material to a desired density and feeds the conditioned loosefill insulation material pneumatically through a distribution hose. Insulation blowing machines typically contain one or more motors configured to drive shredding mechanisms, rotary valves and discharge mechanisms. The motors, shredding mechanisms, rotary valves and discharge mechanisms often operate at elevated sound levels.

It would be advantageous if insulation blowing machines could be improved.

SUMMARY

The above objects as well as other objects not specifically enumerated are achieved by a machine for distributing loosefill insulation material from a package of compressed loosefill insulation material. The machine includes a chute having an inlet end and an outlet end. The inlet end is configured to receive compressed loosefill insulation material. The chute has a first portion in fluid communication with a second portion. The first portion forms an angle with the second portion. A shredding chamber is configured to receive the compressed loosefill insulation material from the outlet end of the chute. The shredding chamber includes a plurality of shredders configured to shred, pick apart and condition the loosefill insulation material thereby forming conditioned loosefill insulation material. A discharge mechanism is mounted to receive the conditioned loosefill insulation material exiting the shredding chamber. The discharge mechanism is configured to distribute the conditioned loosefill insulation material into an airstream. A blower is configured to provide the airstream flowing through the discharge mechanism. The angle between the first portion of the chute and the second portion of the chute is configured to control the descent of the loosefill insulation material into the shredding chamber.

According to this invention there is also provided a machine for distributing loosefill insulation material from a package of compressed loosefill insulation material. The machine includes a chute having an inlet end and an outlet end. The inlet end is configured to receive compressed loosefill insulation material. A lower unit is configured to receive the compressed loosefill insulation material from the outlet end of the chute. The lower unit includes a shredding chamber having a plurality of shredders configured to shred, pick apart and condition the loosefill insulation material. The lower unit has a back panel forming a substantially vertical plane. The lower unit also has opposing spaced apart wheels configured for rotation. A discharge mechanism is mounted to receive the conditioned loosefill insulation material exiting the shredding chamber. The discharge mechanism is configured to distribute the conditioned loosefill insulation material into an airstream. A blower is configured to provide the airstream flowing through the discharge mechanism. The rotational center of the wheels is located a distance from the substantially vertical plane formed by the back panel of the lower unit, such as to increase the stability of the machine during operating and transport.

According to this invention there is also provided a machine for distributing loosefill insulation material from a package of compressed loosefill insulation material. The machine includes a chute having an inlet end and an outlet end. The inlet end is configured to receive compressed loosefill insulation material. The chute has a lower extension. A lower unit has a shredding chamber configured to receive the compressed loosefill insulation material from the outlet end of the chute. The shredding chamber includes a plurality of shredders configured to shred, pick apart and condition the loosefill insulation material. The lower unit has a cavity configured to receive the lower extension of the chute. A discharge mechanism is mounted to receive the conditioned loosefill insulation material exiting the shredding chamber. The discharge mechanism is configured to distribute the conditioned loosefill insulation material into an airstream. A blower is configured to provide the airstream flowing through the discharge mechanism. The chute and the lower unit are secured together in a manner such as to require rotation of the chute to separate the chute from the lower unit.

According to this invention there is also provided a machine for distributing loosefill insulation material from a package of compressed loosefill insulation material. The machine includes a chute having an inlet end and an outlet end. The inlet end is configured to receive compressed loosefill insulation material. A lower unit has a shredding chamber configured to receive the compressed loosefill insulation material from the outlet end of the chute. The shredding chamber includes a plurality of shredders configured to shred, pick apart and condition the loosefill insulation material. A discharge mechanism is mounted to receive the conditioned loosefill insulation material exiting the shredding chamber. The discharge mechanism is configured to distribute the conditioned loosefill insulation material into an airstream. A blower is configured to provide the airstream flowing through the discharge mechanism. A distribution hose assembly is configured to receive the airstream flowing through the discharge mechanism and convey the airstream in a downstream direction. The distribution hose assembly includes a distribution hose connected to the machine and a second distribution hose extending from the distribution hose.

Various objects and advantages of the loosefill insulation blowing machine will become apparent to those skilled in the art from the following detailed description of the preferred embodiment, when read in light of the accompanying drawings.

DETAILED DESCRIPTION OF THE INVENTION

Figure 1:
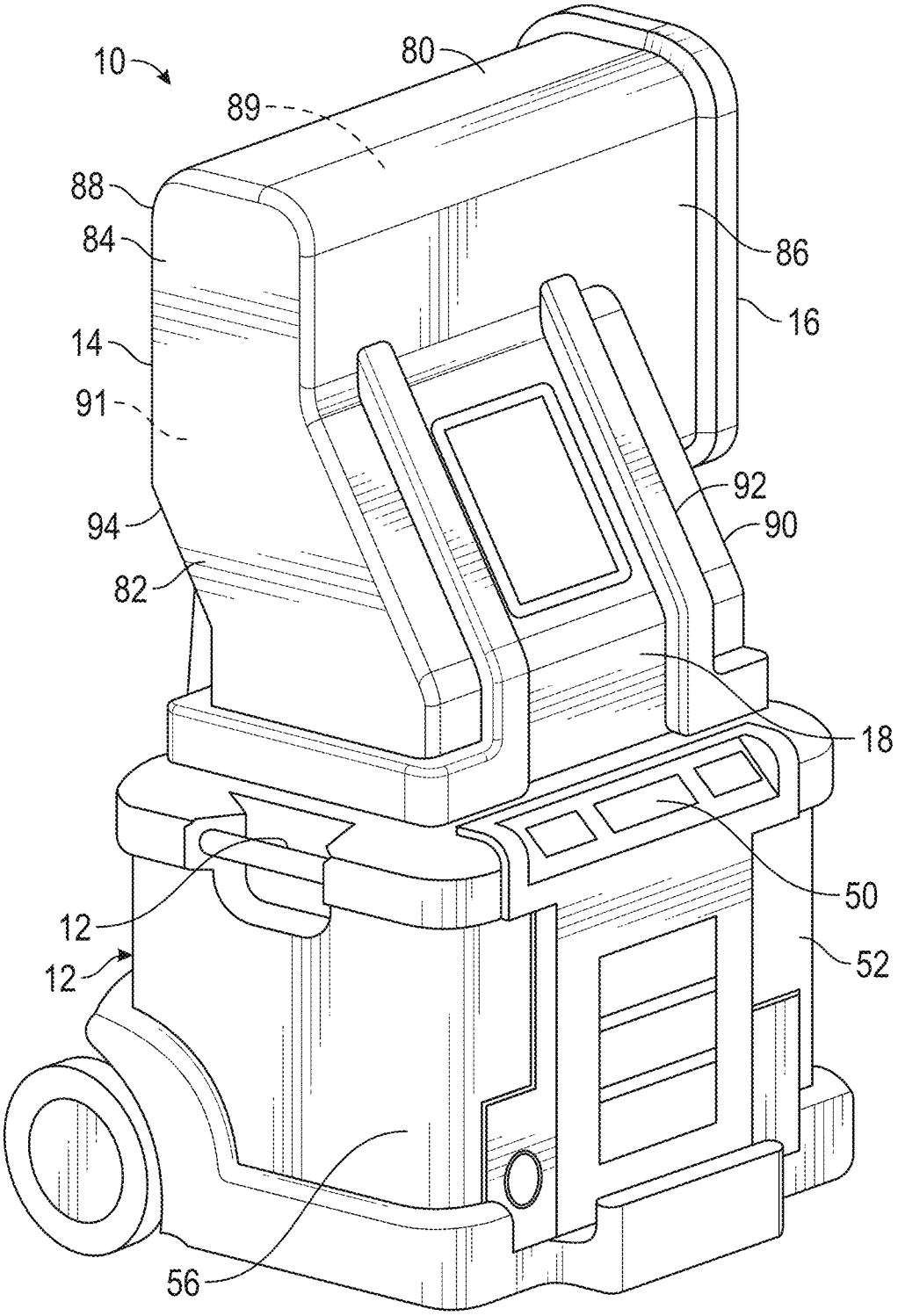
FIG. 1 is a front perspective view of a loosefill insulation blowing machine.

The loosefill insulation blowing machine will now be described with occasional reference to the specific embodiments of the loosefill insulation blowing machine. The loosefill insulation blowing machine may, however, be embodied in different forms and should not be construed as limited to the embodiments set forth herein. Rather, these embodiments are provided so that this disclosure will be thorough and complete, and will fully convey the scope of the loosefill insulation blowing machine to those skilled in the art.

Unless otherwise defined, all technical and scientific terms used herein have the same meaning as commonly understood by one of ordinary skill in the art to which the loosefill insulation blowing machine belongs. The terminology used in the description of the loosefill insulation blowing machine herein is for describing particular embodiments only and is not intended to be limiting of the loosefill insulation blowing machine. As used in the description of the loosefill insulation blowing machine and the appended claims, the singular forms "a," "an," and "the" are intended to include the plural forms as well, unless the context clearly indicates otherwise.

Unless otherwise indicated, all numbers expressing quantities of dimensions such as length, width, height, and so forth as used in the specification and claims are to be understood as being modified in all instances by the term "about." Accordingly, unless otherwise indicated, the numerical properties set forth in the specification and claims are approximations that may vary depending on the desired properties sought to be obtained in embodiments of the loosefill insulation blowing machine. Notwithstanding that the numerical ranges and parameters setting forth the broad scope of the loosefill insulation blowing machine are approximations, the numerical values set forth in the specific examples are reported as precisely as possible. Any numerical values, however, inherently contain certain errors necessarily resulting from error found in their respective measurements.

In accordance with the illustrated embodiments, the description and figures disclose a loosefill insulation blowing machine. The loosefill insulation blowing machine includes a chute and a plurality of shredders configured to shred, pick apart and condition the loosefill insulation material. The chute includes a first portion in fluid communication with a second portion, with the first portion forming an angle with the second portion. The angle is configured to provide a controlled descent for the loosefill insulation material as the loosefill insulation transitions from the chute and enters the shredding chamber. The loosefill insulation blowing machine also includes wheels having a rotational center located a distance from the substantially vertical plane formed by the back panel of the machine, such as to increase the stability of the machine during operating and transport. The loosefill insulation blowing machine further includes a lower unit secured to the chute in a manner such as to require rotation of the chute to separate the chute from the lower unit. The loosefill insulation blowing machine also includes a distribution hose assembly configured to receive an airstream flowing through a discharge mechanism and convey the airstream in a downstream direction. The distribution hose assembly includes a distribution hose connected to the machine and a second distribution hose extending from the distribution hose.

The term "loosefill insulation", as used herein, is defined to mean any insulating materials configured for distribution in an airstream. The term "finely conditioned", as used herein, is defined to mean the shredding, picking apart and conditioning of loosefill insulation material to a desired density prior to distribution into an airstream.

Referring now to FIGS. 1-4, a loosefill insulation blowing machine (hereafter "blowing machine") is shown generally at 10. The blowing machine 10 is configured for conditioning compressed loosefill insulation material and further configured for distributing the conditioned loosefill insulation material to desired locations, such as for example, insulation cavities. The blowing machine 10 includes a lower unit 12 and a chute 14. The lower unit 12 is connected to the chute 14 by one or more fastening mechanisms (not shown) configured to readily assemble and disassemble the chute 14 to the lower unit 12. The chute 14 has an inlet end 16 and an outlet end 18.

Referring again to FIGS. 1-4, the inlet end 16 of the chute 14 is configured to receive compressed loosefill insulation material. The compressed loosefill insulation material is guided within the interior of the chute 14 to the outlet end 18, wherein the loosefill insulation material is introduced to a shredding chamber 23 as shown in FIG. 3.

Referring again to FIGS. 1, 2 and 4, optionally the lower unit 12 can include one or more handle segments 21, configured to facilitate ready movement of the blowing machine 10 from one location to another. However, it should be understood that the one or more handle segments 21 are not necessary to the operation of the blowing machine 10.

Referring again to FIGS. 1-4, the chute 14 can include an optional bail guide (not shown for purposes of clarity) mounted at the inlet end 16 of the chute 14. The bail guide is configured to urge a package of compressed loosefill insulation material against an optional cutting mechanism (also not shown for purposes of clarity) as the package of compressed loosefill insulation material moves further into the chute 14. The bail guide and the cutting mechanism can have any desired structure and operation.

Figure 2:
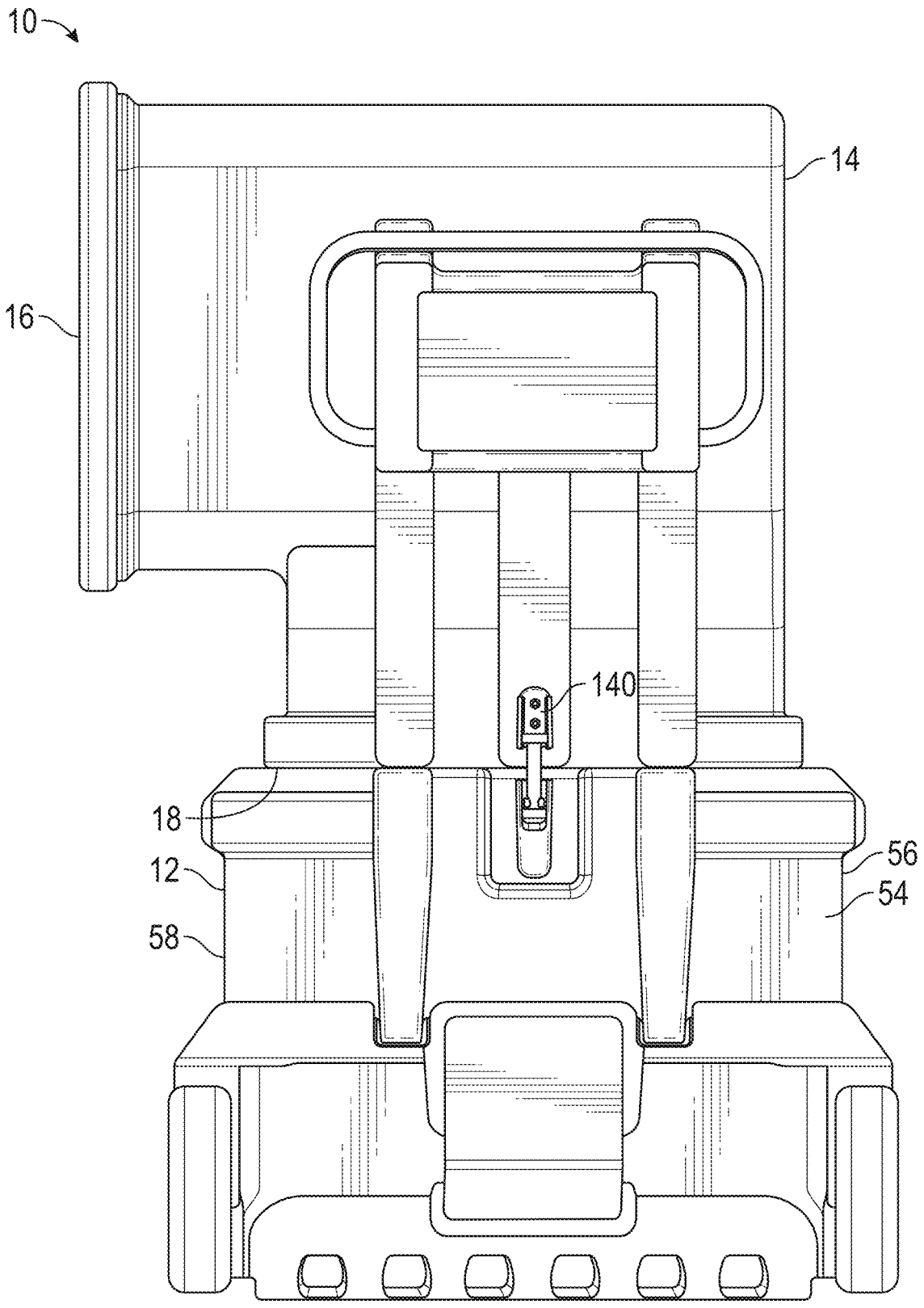
FIG. 2 is a rear elevational view of the loosefill insulation blowing machine of FIG. 1.
Figure 3:
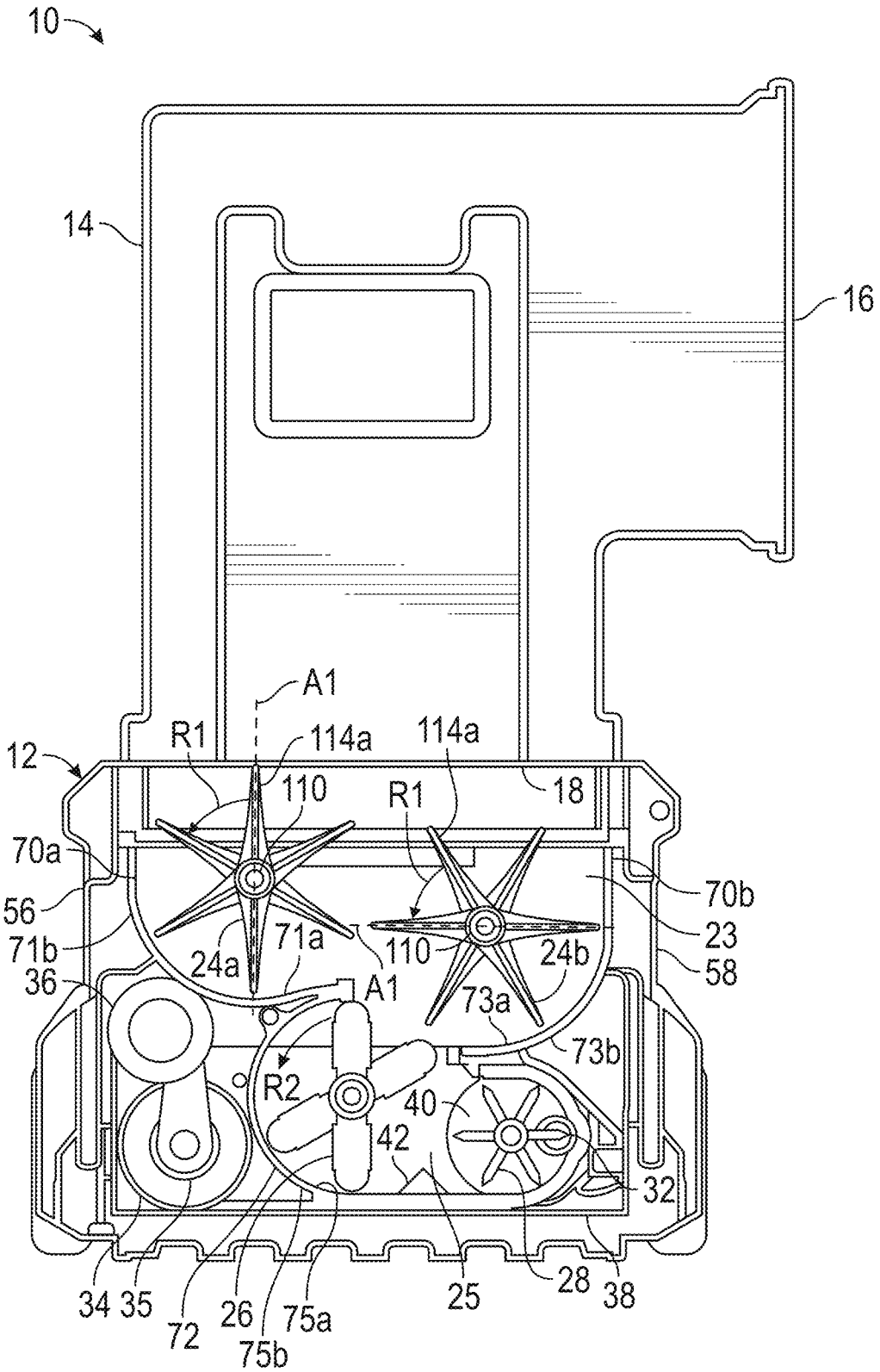
FIG. 3 is a front elevational view, partially in cross-section, of the loosefill insulation blowing machine of FIG. 1.

Referring now to FIGS. 1 and 2, the lower unit 12 includes a front panel 52, a back panel 54, a left side panel 56 and a right side panel 58. In the illustrated embodiment, the panels 52, 54, 56 and 58 are formed from a polymeric material. However, in other embodiments, the panels 52, 54, 56 and 58 can be formed from other desired materials including the non-limiting example of aluminum.

Referring now to FIG. 3, the shredding chamber 23 is mounted at the outlet end 18 of the chute 14. The shredding chamber 23 includes first and second low speed shredders 24*a*, 24*b* and one or more agitators 26. The first and second low speed shredders 24*a*, 24*b* are configured to shred, pick apart and condition the loosefill insulation material as the loosefill insulation material is discharged into the shredding chamber 23 from the outlet end 18 of the chute 14. The agitator 26 is configured to finely condition the loosefill insulation material to a desired density as the loosefill insulation material exits the first and second low speed shredders 24*a*, 24*b*. It should be appreciated that although a quantity of two low speed shredders 24*a*, 24*b* and a lone agitator 26 are illustrated, any desired quantity of low speed shredders 24*a*, 24*b* and agitators 26 can be used. Further, although the blowing machine 10 is shown with first and second low speed shredders 24*a*, 24*b*, any type of separator, such as a clump breaker, beater bar or any other mechanism, device or structure that shreds, picks apart and conditions the loosefill insulation material can be used.

Referring again to FIG. 3, the first and second low speed shredders 24*a*, 24*b* rotate in a counter-clockwise direction R1 and the agitator 26 rotates in a counter-clockwise direction R2. Rotating the low speed shredders 24*a*, 24*b* and the agitator 26 in the same counter-clockwise direction allows the low speed shredders 24*a*, 24*b* and the agitator 26 to shred and pick apart the loosefill insulation material while substantially preventing an accumulation of unshredded or partially shredded loosefill insulation material in the shredding chamber 23. However, in other embodiments, each of the low speed shredders 24*a*, 24*b* and the agitator 26 could rotate in a clock-wise direction or the low speed shredders 24*a*, 24*b* and the agitator 26 could rotate in different directions provided the relative rotational directions allow finely shredded loosefill insulation material to be fed into the discharge mechanism 28 while preventing a substantial accumulation of unshredded or partially shredded loosefill insulation material in the shredding chamber 23.

Referring again to FIG. 3, the agitator 26 is configured to finely condition the loosefill insulation material, thereby forming finely conditioned loosefill insulation material and preparing the finely conditioned loosefill insulation material for distribution into an airstream. In the embodiment illustrated in FIG. 3, the agitator 26 is positioned vertically below the first and second low speed shredders 24*a*, 24*b*. Alternatively, the agitator 26 can be positioned in any desired location relative to the first and second low speed shredders 24*a*, 24*b*, sufficient to receive the loosefill insulation material from the first and second low speed shredders 24*a*, 24*b*, including the non-limiting example of being positioned horizontally adjacent to the first and second low speed shredders 24*a*, 24*b*. In the illustrated embodiment, the agitator 26 is a high speed shredder. Alternatively, the agitator 26 can be any type of shredder, such as a low speed shredder, clump breaker, beater bar or any other mechanism that finely conditions the loosefill insulation material and prepares the finely conditioned loosefill insulation material for distribution into an airstream.

In the embodiment illustrated in FIG. 3, the first and second low speed shredders 24*a*, 24*b* rotate at a lower rotational speed than the rotational speed of the agitator 26. The first and second low speed shredders 24*a*, 24*b* rotate at a rotational speed of about 40-80 rpm and the agitator 26 rotates at a rotational speed of about 300-500 rpm. In other embodiments, the first and second low speed shredders 24*a*, 24*b* can rotate at rotational speeds less than or more than 40-80 rpm and the agitator 26 can rotate at rotational speeds less than or more than 300-500 rpm. In still other embodiments, the first and second low speed shredders 24*a*, 24*b* can rotate at rotational speeds different from each other.

Referring again to FIG. 3, a discharge mechanism 28 is positioned adjacent to the agitator 26 and is configured to distribute the finely conditioned loosefill insulation material exiting the agitator 26 into an airstream. The finely conditioned loosefill insulation material is driven through the discharge mechanism 28 and through a machine outlet 32 by an airstream provided by a blower 34 and associated ductwork (not shown) mounted in the lower unit 12. The blower 34 is mounted for rotation and is driven by a blower motor 35. The airstream is indicated by an arrow 33 in FIG. 4. In other embodiments, the airstream 33 can be provided by other methods, such as by a vacuum, sufficient to provide an airstream 33 driven through the discharge mechanism 28.

Referring again to FIG. 3, the blower motor 35 is illustrated. The blower motor 35 is configured for 120 volt alternating current (A.C.) operation and is sized to require a maximum current of 11.0 amps. Further, the blower motor 35 is of a flow-through type and has a maximum rotational speed in a range of about 30,000 revolutions per minute to about 40,000 revolutions per minute. The blower motor 35 is configured for pulse width modulation control, thereby allowing for fine control and variability in the rotational speed of the blower 34. The variable rotational speed of the blower 34 will be discussed in more detail below.

Referring again to FIG. 3, the first and second shredders 24*a*, 24*b*, agitator 26 and discharge mechanism 28 are mounted for rotation. They can be driven by any suitable means, such as by an electric motor 36, or other means sufficient to drive rotary equipment. Alternatively, each of the first and second shredders 24*a*, 24*b*, agitator 26 and discharge mechanism 28 can be provided with its own source of rotation.

Referring again to FIG. 3, the lower unit 12 includes a first shredder guide shell 70*a*, a second shredder guide shell 70*b* and an agitator guide shell 72. The first shredder guide shell 70*a* is positioned partially around the first low speed shredder 24*a* and extends to form an arc of approximately 90°. The first shredder guide shell 70*a* has an inner surface 71*a* and an outer surface 71*b*. The first shredder guide shell 70*a* is configured to allow the first low speed shredder 24*a* to seal against the inner surface 71*a* of the shredder guide shell 70*a* and thereby urge loosefill insulation material in a direction toward the second low speed shredder 24*b*.

Referring again to FIG. 3, second shredder guide shell 70*b* is positioned partially around the second low speed shredder 24*b* and extends to form an arc of approximately 90°. The second shredder guide shell 70*b* has an inner surface 73*a* and an outer surface 73*b*. The second shredder guide shell 70*b* is configured to allow the second low speed shredder 24*b* to seal against the inner surface 73*a* of the second shredder guide shell 70*b* and thereby urge the loosefill insulation in a direction toward the agitator 26.

In a manner similar to the shredder guide shells, 70*a*, 70*b*, the agitator guide shell 72 is positioned partially around the agitator 26 and extends to form an arc of approximate 90°. The agitator guide shell 72 has an inner surface 75*a* and an outer surface 75*b*. The agitator guide shell 72 is configured to allow the agitator 26 to seal against the inner surface 75*a* of the agitator guide shell 72 and thereby direct the loosefill insulation in a downstream direction toward the discharge mechanism 28.

In the embodiment illustrated in FIG. 3, the shredder guide shells 70*a*, 70*b* and the agitator guide shell 72 are formed from a polymeric material. However, in other embodiments, the shells 70*a*, 70*b* and 72 can be formed from other desired materials including the non-limiting example of aluminum.

Referring again to FIG. 3, the shredding chamber 23 includes a floor 38 positioned below the blower 34, the agitator 26 and the discharge mechanism 28. In the illustrated embodiment, the floor 38 is arranged in a substantially horizontal plane and extends substantially across the lower unit 12. In the embodiment illustrated in FIG. 3, the floor 38 is formed from a polymeric material. However, in other embodiments, the floor 38 can be formed from other desired materials including the non-limiting example of aluminum.

Referring again to FIGS. 1-4, in operation, the inlet end 16 of the chute 14 receives compressed loosefill insulation material. As the compressed loosefill insulation material expands within the chute 14, the chute 14 guides the loosefill insulation material past the outlet end 18 of the chute 14 to the shredding chamber 23. The first low speed shredder 24*a* receives the loosefill insulation material and shreds, picks apart and conditions the loosefill insulation material. The loosefill insulation material is directed by the combination of the first low speed shredder 24*a* and the first shredder guide shell 70*a* to the second low speed shredder 24*b*. The second low speed shredder 24*b* receives the loosefill insulation material and further shreds, picks apart and conditions the loosefill insulation material. The loosefill insulation material is directed by the combination of the second low speed shredder 24*b* and the second shredder guide shell 70*b* to the agitator 26.

Figure 4:
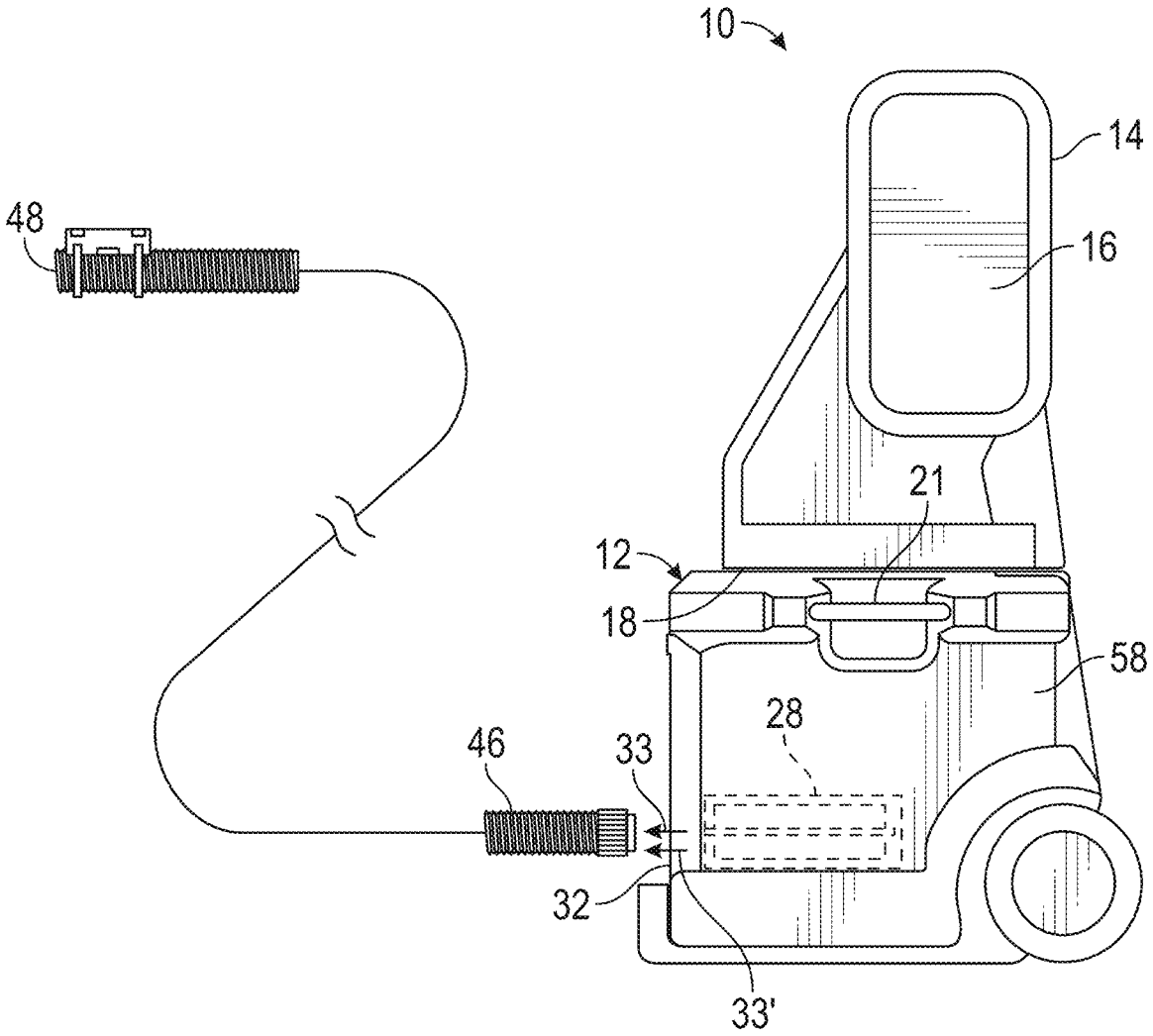
FIG. 4 is a side elevational view of the loosefill insulation blowing machine of FIG. 1, illustrating a distribution hose.

The agitator 26 is configured to finely condition the loosefill insulation material and prepare the loosefill insulation material for distribution into the airstream 33 by further shredding and conditioning the loosefill insulation material. The finely conditioned loosefill insulation material, guided by the agitator guide shell 72, exits the agitator 26 at an outlet end 25 of the shredding chamber 23 and enters the discharge mechanism 28 for distribution into the airstream 33 provided by the blower 34. The airstream 33, entrained with the finely conditioned loosefill insulation material, exits the insulation blowing machine 10 at the machine outlet 32 and flows through a distribution hose 46, as shown in FIG. 4, toward an insulation cavity, not shown.

Referring again to FIG. 3, the discharge mechanism 28 has a side inlet 40 and an optional choke 42. The side inlet 40 is configured to receive the finely conditioned blowing insulation material as it is fed from the agitator 26. In the illustrated embodiment, the agitator 26 is positioned adjacent to the side inlet 40 of the discharge mechanism 28. In other embodiments, the low speed shredders 24*a*, 24*b* or agitator 26, or other shredding mechanisms can be positioned adjacent to the side inlet 40 of the discharge mechanism 28 or in other suitable positions.

Referring again to FIG. 3, the optional choke 42 is configured to partially obstruct the side inlet 40 of the discharge mechanism 28 such that heavier clumps of blowing insulation material are prevented from entering the side inlet 40 of the discharge mechanism 28. The heavier clumps of blowing insulation material are redirected past the side inlet 40 of the discharge mechanism 28 to the shredders 24*a*, 24*b* for recycling and further conditioning.

Referring again to FIG. 4, and as described above, the airstream 33 exits the discharge mechanism 28 with the entrained finely conditioned loosefill insulation material. The airstream 33 is conveyed by the distribution hose 46 until the airstream 33 exits the distribution hose 46 at a hose outlet 48. In certain instances, stray fibers of the finely conditioned loosefill insulation material can become airborne during the distribution process. The presence of these stray fibers in unwanted locations, such as on clothing, can be an unwanted nuisance.

Referring again to FIG. 1, the machine 10 is illustrated with the lower unit 12 and the chute 14. The chute 14 is configured to guide compressed loosefill insulation material through the interior of the chute 14 to the outlet end 18 of the chute 14, wherein the loosefill insulation material is introduced to the shredding chamber 23. The chute 14 includes a first portion 80 and a second portion 82. The first portion 80 extends from the inlet end 16 to a side wall 84 and from a first portion front wall 86 to a first portion rear wall 88. The inlet end 16, side wall 84, first portion front wall 86 and first portion rear wall 88 define a first portion internal passage 89.

Referring again to FIG. 1, the second portion 82 extends from a second portion side wall 90 to the side wall 84 and between the second portion front wall 92 to a second portion rear wall 94. The second portion side wall 90, side wall 84, second portion front wall 92 and second portion rear wall 94 defined a second portion internal passage 91. The first portion internal passage 89 and the second portion internal passage 91 are in fluid communication with each other.

Figure 5:
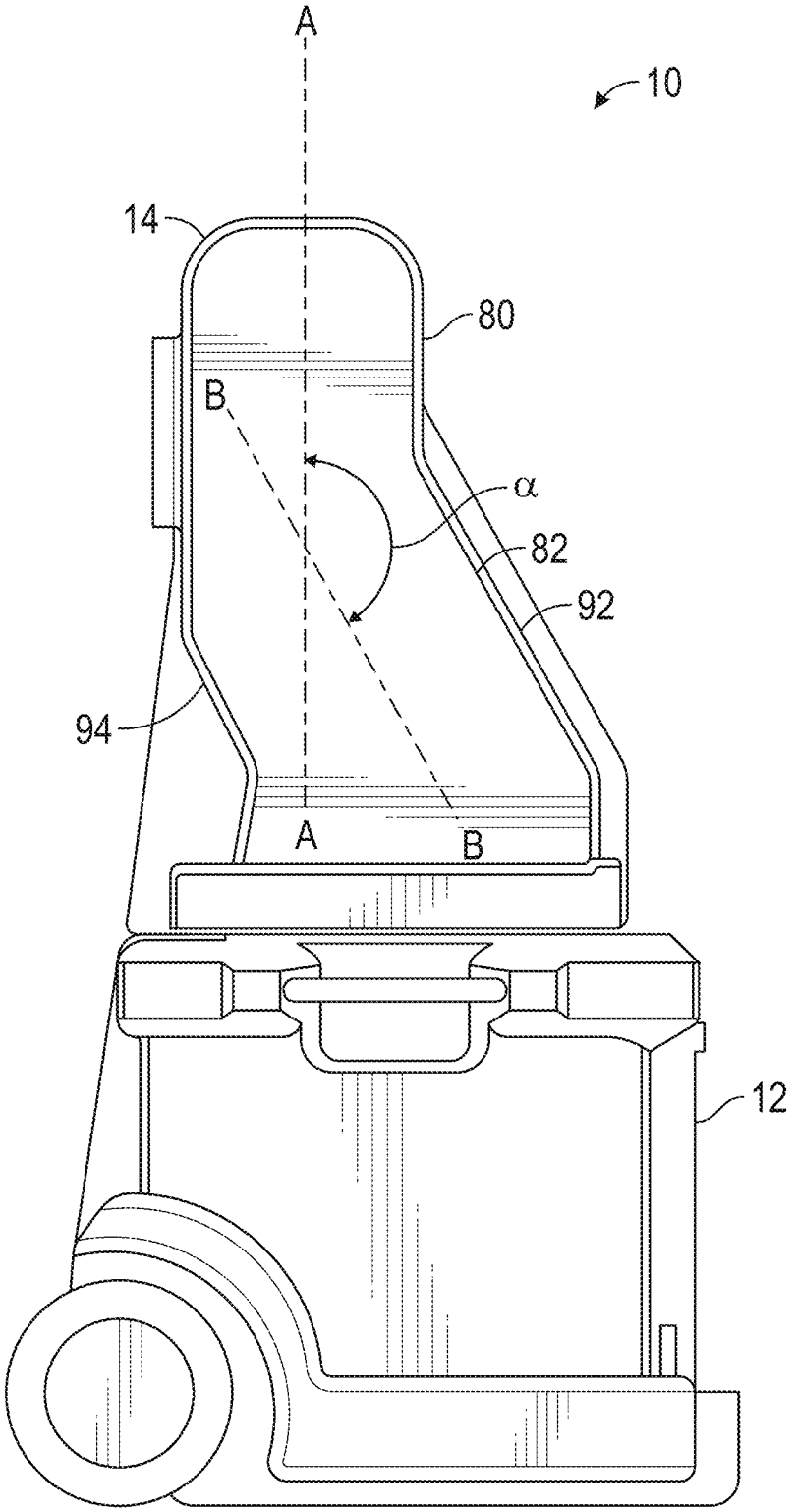
FIG. 5 is a side elevational view of the loosefill insulation blowing machine of FIG. 1, illustrating a chute having first and second portions.

Referring now to FIG. 5, the first and second portions 80, 82 of the chute 14 are illustrated. The first portion front wall 86 and the first portion rear wall 88 have a substantially vertical and parallel orientation, and are centered about a substantially vertical plane A-A.

Referring again to FIG. 5, the second portion front wall 92 and the second portion rear wall have a parallel orientation and are centered about a plane B-B. The intersection of the planes A-A and B-B forms an angle $\alpha$. As will be explained in more detail below, angle $\alpha$ is configured to provide a controlled descent for the loosefill insulation material as the loosefill insulation transitions from the chute 14 and enters the shredding chamber 23.

In the embodiment of the chute 14 illustrated in FIG. 5, the angle $\alpha$ is in a range of from about 140° to about 160°. However, in other embodiments, the angle $\alpha$ can be less than about 140° or more than about 160°, sufficient to provide a controlled descent for the loosefill insulation material exiting the chute 14 and entering the shredding chamber 23.

Figure 6A:
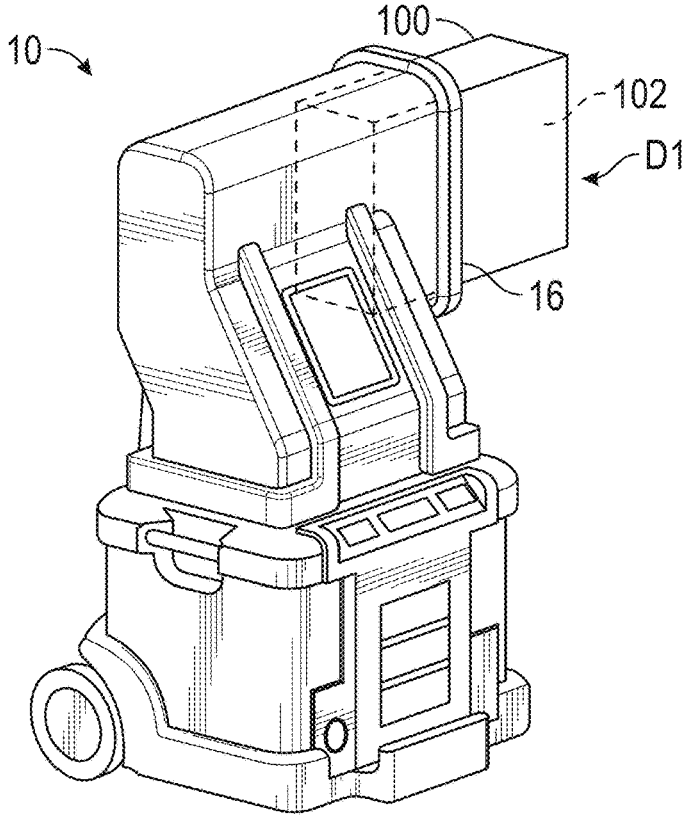
FIG. 6A is a perspective view of the loosefill insulation blowing machine of FIG. 5, illustrating loading of a package of loosefill insulation material into the first portion of the chute.
Figure 6B:
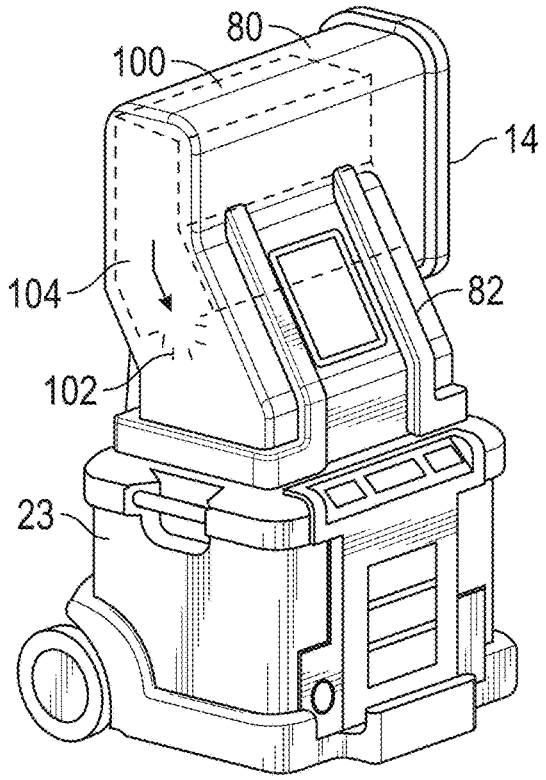
FIG. 6B is a perspective view of the loosefill insulation blowing machine of FIG. 5, illustrating loading of a package of loosefill insulation material into the second portion of the chute

Referring now to FIGS. 6A and 6B, operation of the chute will now be described. Referring first to FIG. 6A, a package 100 of compressed loosefill insulation material is fed into the inlet end 16 of the chute 14 as illustrated by direction arrow D1. The package 100 includes compressed loosefill insulation material 102. In this embodiment, the package 100 of compressed loosefill insulation material is fed into the inlet end 16 of the chute 14 in a manner such that the package 100 has a substantially vertical orientation. The term "substantially vertical orientation", as used herein is defined to mean opposing major sides of the package 100 are substantially parallel to an axis having a vertical orientation.

Referring again to FIG. 6A, as the package 100 enters the chute 14, the package 100 is initially guided within the first portion internal passage 89 by the first portion front wall 86 and first portion rear wall 88, thereby maintaining the package 100 in a substantially vertical orientation.

Referring now to FIG. 6B, the package 100 has proceeded into the chute 14 a distance sufficient that portions of the package 100 encounter the second portion rear wall 94. The angle α formed by the first portion rear wall 88 and the second portion rear wall 94 is sufficient that a portion of the package 100 forms a bend 104. As loosefill insulation material 102 expands and exits the package 100, the bend 104 in the package 100 and the angle α formed by the second portion 82 of the chute 14, cooperate to control the descent of the loosefill insulation material 102 into the shredding chamber 23. Without being held to the theory, it is believed the controlled descent of the loosefill insulation material 102, as the loosefill insulation material 102 enters the shredding chamber, helps prevents jamming of the low speed shredders 24*a*, 24*b*.

Figure 7:
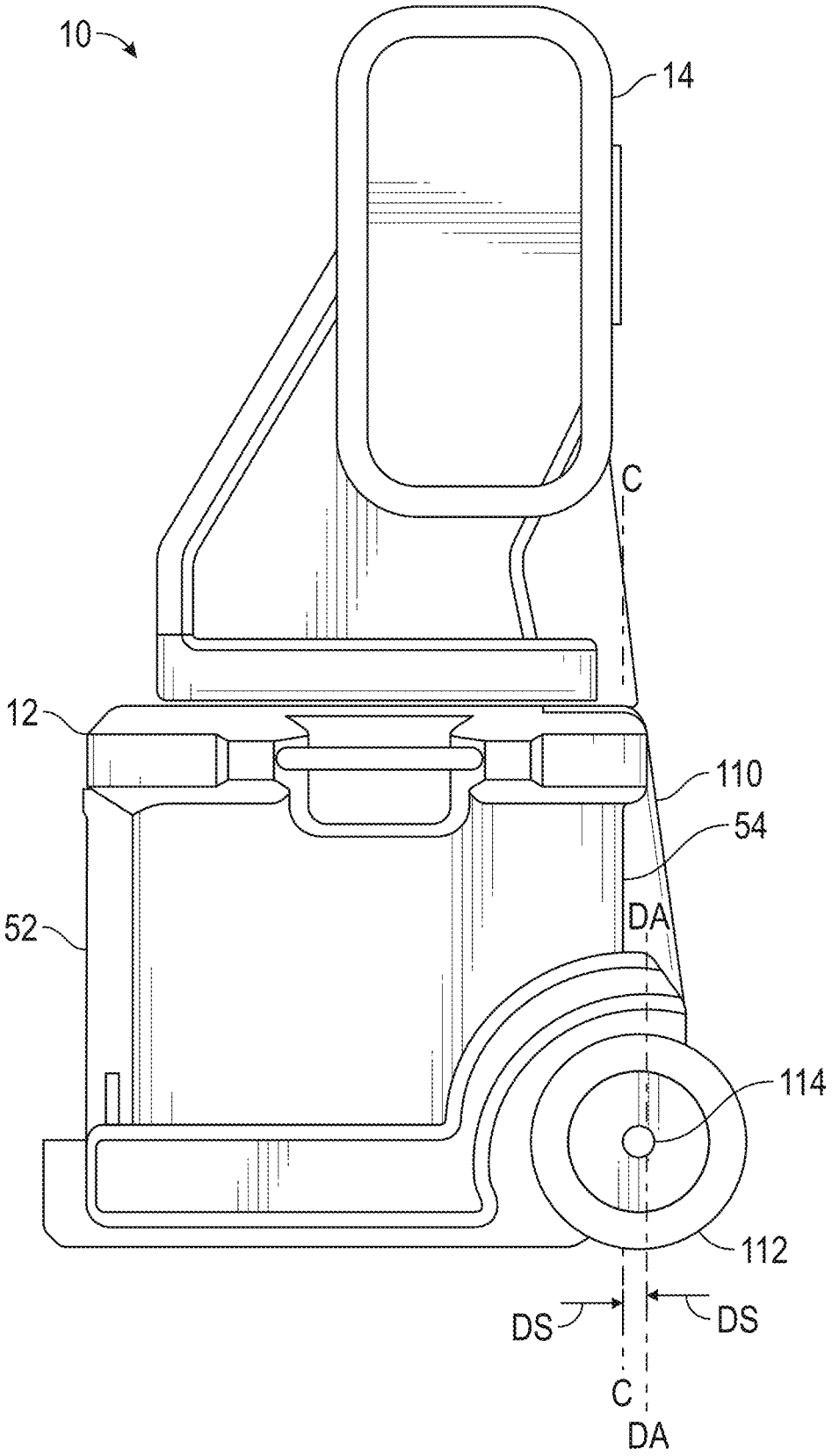
FIG. 7 is side elevational view of the loosefill insulation blowing machine of FIG. 1, illustrating an offset wheel axle.

Referring now to FIG. 7, a side view of the machine 10 is illustrated with the machine 10 having the lower unit 12 and chute 14. The lower unit 12 includes a front panel 52, the back panel 54 and a plurality of support segments 110 extending outwardly from the back panel 54. In the illustrated embodiment, the back panel 54 has a substantially vertical orientation. The term "substantially vertical orientation", as used herein is defined to mean the back panel 54 is substantially parallel to plane C-C, with plane C-C having a vertical orientation.

Referring again to FIG. 7, the lower unit 12 includes space apart wheels 112 configured for rotation about an axle 114. A rotational center of the axle 114 is positioned within a vertical plane DA-DA. As shown in FIG. 7, the vertical plane DA-DA, representing the rotational center of the axle 114, is located a distance DS to the rear of the vertical plane C-C, representing the back panel 54 of the lower unit 12. It is believed positioning of the rotational center of the axle 114 to the rear of the back panel 54 of the lower unit 12 advantageously increases the stability of the machine 10 during operating and transport.

Referring again to FIG. 7, the distance DS is in a range of from about 1.0 inch to about 3.0 inches. Alternatively, the distance DS could be less than about 1.0 inch or more than about 3.0 inches, sufficient to increase the stability of the machine 10 during operating and transport.

Figure 8:
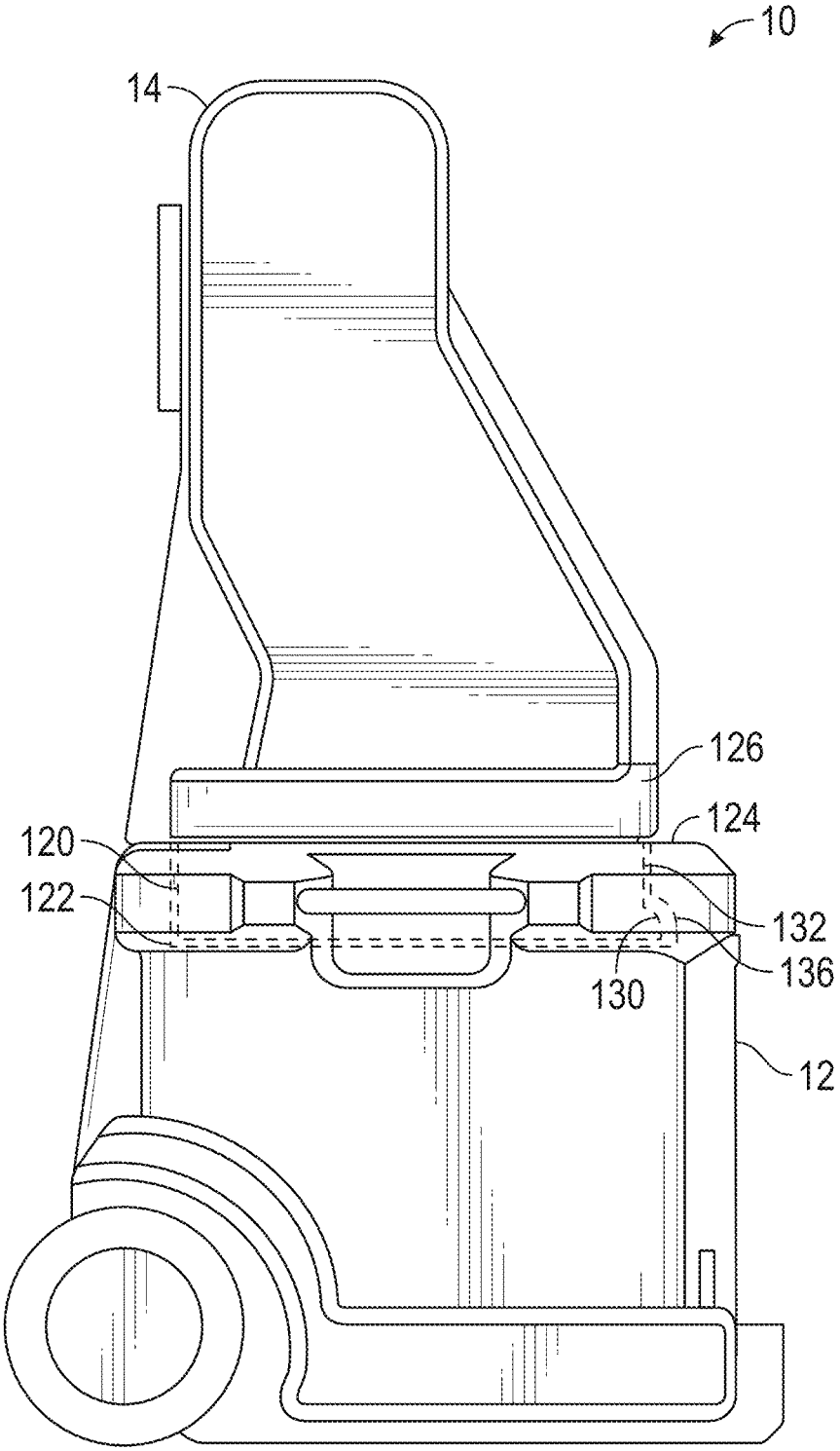
FIG. 8 is side elevational view of the loosefill insulation blowing machine of FIG. 1, illustrating a lower extension of the chute seating within a cavity in the lower unit.

Referring now to FIG. 8, a side view of the machine 10, lower unit 12 and chute 14 is illustrated. The chute 14 includes a lower extension 120 configured to seat within a mating cavity 122 formed at a top portion 124 of the lower unit 12. In a seated position, a rim 126 extending circumferentially around a portion of the chute 14, rests on the top portion 124 of the lower unit 12. The lower extension 120 of the chute 14 includes a projection 130, extending along a front edge 132 of the lower extension 120. The projection 130 is configured to mate with a recess 136 located within the lower unit 12 and extending from the cavity 122. The projection 130 is configured for several functions. First, the projection 130 is configured to slide into the recess 136 in the lower unit 12. Second, the projection 130 is configured to orient the chute 14 in a desired arrangement relative to the lower unit 12. Finally, once in a seated orientation, the projection 130 is configured for contact with the recess 136 such that the chute 14 cannot be lifted from the lower unit 12 without rotation of the chute.

In the embodiment illustrated in FIG. 8, the projection 130 has the cross-sectional form of a lip and the recess 136 has a matching concave cross-sectional shape. However, in other embodiments, the projection 130 and the mating recess 136 can have other cross-sectional shapes sufficient for the functions discussed above.

Referring now to FIG. 2, once the projection (not shown) extending from the chute 14 is seated with the recess (not shown) in the chute 14, the lower unit 12 and the chute 14 can be secured together with a clasp 140. The clasp 140 extends between the lower unit 12 and the chute 14 and is positioned at the rear of the lower unit 12 and the chute 14. In the illustrated embodiment, the clasp 140 has the form of a spring-loaded toggle latch. However, the clasp can have other desired forms sufficient to secure the lower unit 12 to the chute 14 once the projection extending from the chute 14 is seated within the recess of the lower unit 12.

Referring again to FIGS. 2 and 8, the combination of the mating projection 130 and recess 136 and the clasp 140 provides several advantages, although all advantages may not be present in all embodiments. First, use of the use of mating projection 130 and recess 136 provides that the chute 14 cannot removed from the lower unit 12 without a deliberate rotation of the chute 14. Second, use of the use of mating projection 130 and recess 136 provides that the chute 14 cannot be assembled to the lower unit 12 with an incorrect orientation. Third, use of a single clasp 140 provides a time savings over the use of multiple clasps. Finally, positioning of the clasp 140 at the rear of the machine 10, advantageously moves a potential catch point out of the way of users of the machine.

Figure 9:
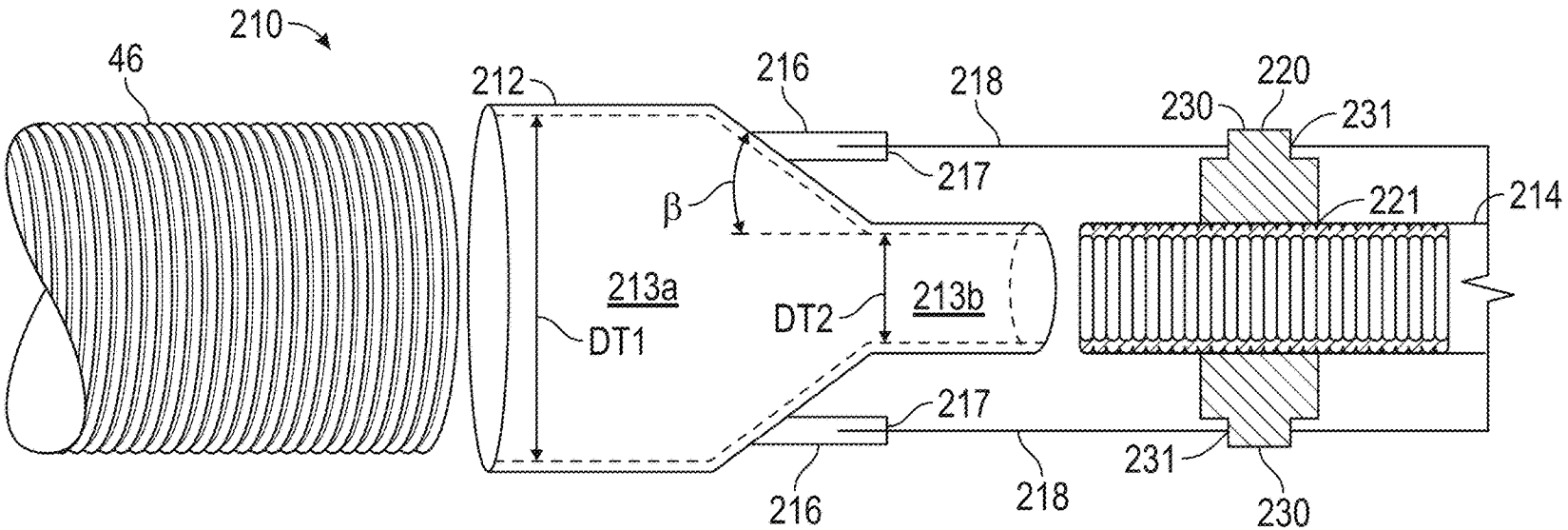
FIG. 9 is a side elevational view of a distribution hose assembly.
Figure 10:
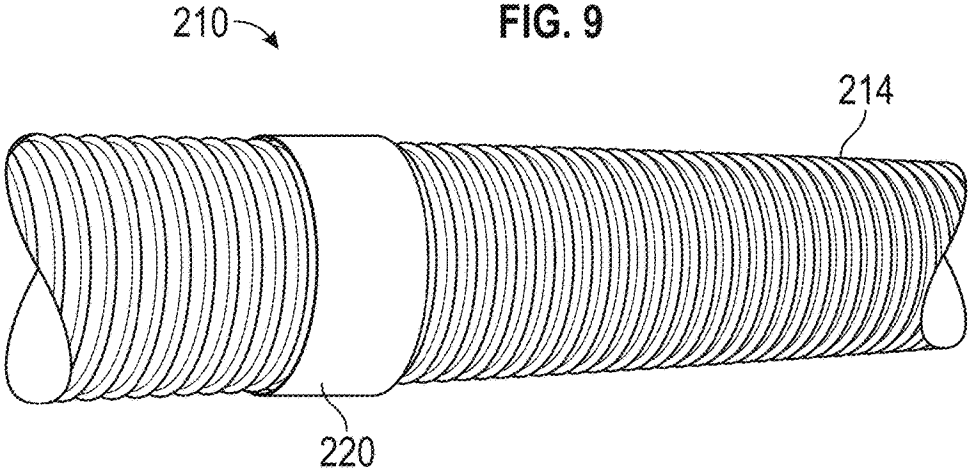
FIG. 10 is a side elevational view of the distribution hose assembly of FIG. 9, illustrating a second distribution hose and a connecting member.
Figure 11:
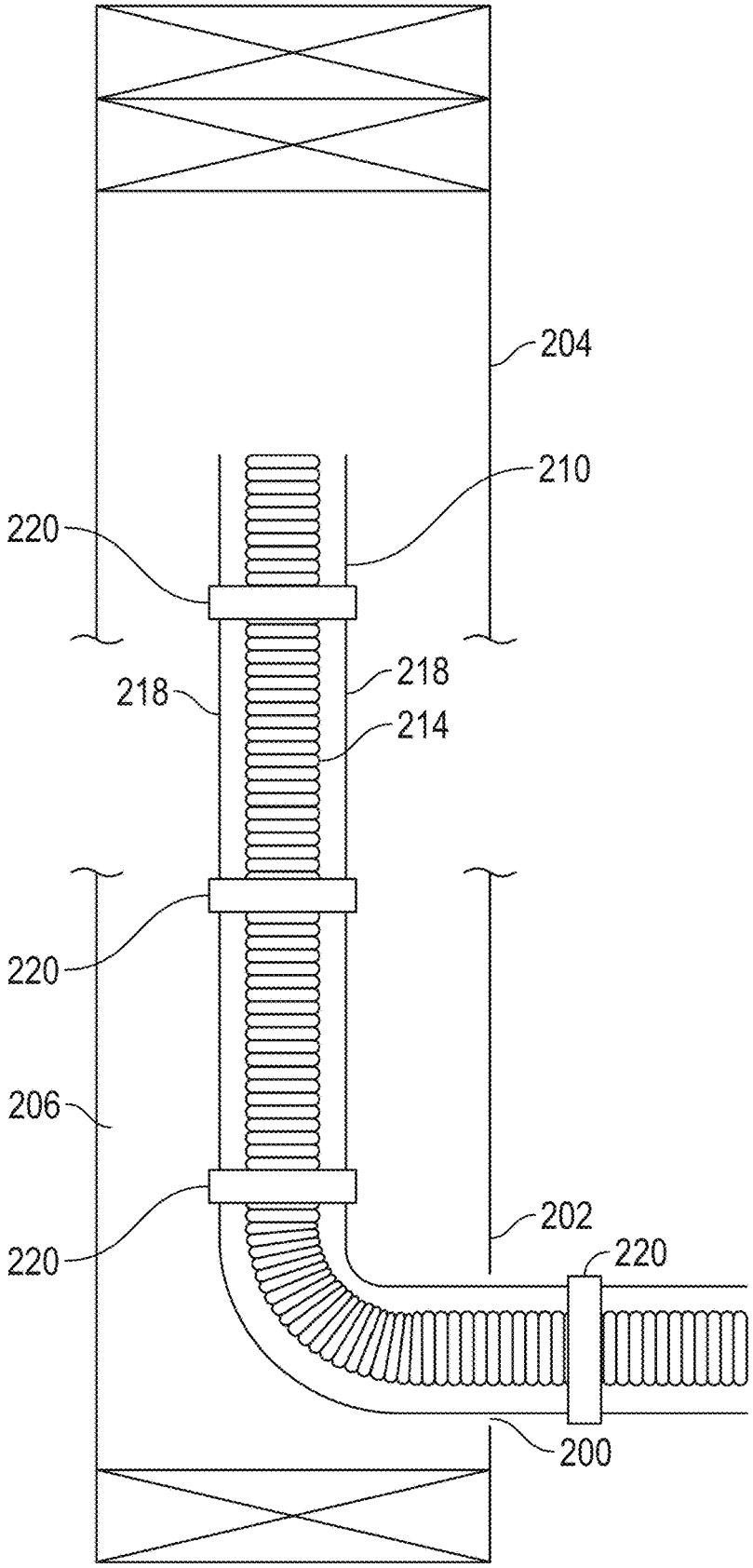
FIG. 11 is a front view of the distribution hose assembly of FIG. 9, shown within an insulation cavity.

Referring now to FIGS. 9-11, the machine 10 can be configured for use in distributing loosefill insulation material to areas with a confined access, such as for example wall cavities formed within existing walls. To limit the repair to the existing walls, it is desirable to limit the number and size of the penetrations made to the existing wall. Referring now to FIG. 11, in certain instances, it is also desirable to distribute the loosefill insulation material from an access point 200 positioned at a lower portion 202 of a wall 204. In this scenario, the distribution hose 46 extends in an upward position within an insulation cavity 206 formed within the wall 204.

Referring again to FIGS. 9-11, a distribution hose assembly is illustrated generally at 210. The distribution hose assembly 210 includes the distribution hose 46, a transition element 212, a second distribution hose 214, a plurality of connection ports 216, a corresponding plurality of reinforcing members 218 and a plurality of spaced apart connecting members 220.

Referring now to FIG. 9, the transition element 212 is configured to receive the distribution hose 46 and couple the distribution hose 46 with the second distribution hose 214. The transition element 212 includes a first internal passage 213*a* and a second internal passage 213*b*. The first internal passage 213*a* has a diameter DT1 that approximates an outer diameter of the distribution hose 46 and the second internal passage 213*b* has a diameter DT2 that approximates the outer diameter of the second distribution hose 214. The transition element 212 is configured to provide a reduction in the diameter of the airstream flowing from the distribution hose 46 to the second distribution hose 214. Reducing the airstream to the smaller diameter of the second distribution hose 214 advantageously allows an installer to cut smaller access holes 200 in the wall 204 and further minimizes the aesthetic impact to the building.

Referring again to FIG. 9, the transition element 212 includes a transition angle β. The transition angle β is configured for several functions. First, the transition angle β is configured to minimize accumulation of loosefill insulation material within the transition element 212. Second, transition angle β is configured to accelerate the flow of the airstream and the entrained loosefill insulation material into the second distribution hose 214, thereby enabling a more effective filling of the wall cavity 206. In the illustrated embodiment, the transition angle β is in a range of from about 30° to about 40°. However, in other embodiments, the transition angle β can be less than about 30° or more than about 40°, sufficient to achieve the functions described above.

Referring again to FIG. 9, the connection ports 216 are integrated into the transition element 212 and configured to secure the reinforcing members 218. In the illustrated embodiment, the connection ports 216 include an aperture 217 configured to receive the reinforcing members 218 with a friction fit. Alternatively, other mechanisms devices and structures can be used to secure the reinforcing members 218 to transition element 212, such as the non-limiting examples of clips and clamps.

Referring again to FIG. 9, reinforcing members 218 are positioned adjacent to and generally parallel with the second distribution hose 214 and are configured to limit bending movement of the second distribution hose 214, thereby maintaining the second distribution hose 214 in a generally straight and upright orientation within the wall cavity 206. The straight and upright orientation of the second distribution hose 214 advantageously prevents the second distribution hose 214 from coiling within the wall cavity 206, thereby providing the installer with more control over the distribution process. In the illustrated embodiment, the reinforcing members 218 are formed from a fiberglass-based material in a rod-like form configured to provide sufficient rigidity to maintain the second distribution hose 214 in a generally straight and upright orientation. In other embodiments, the reinforcing members 214 can be formed from other materials, such as for example aluminum and can have other forms, such as for example connected segments, sufficient to maintain the second distribution hose 214 in a generally straight and upright orientation. In the embodiment illustrated in FIG. 9, a quantity of two (2) reinforcing members 218 are illustrated. Alternatively, more or less than two (2) reinforcing members 218 can be used, sufficient to maintain the second distribution hose 214 in a generally straight and upright orientation.

Referring now to FIGS. 9 and 10, the connecting members 220 are spaced apart along the length of the second distribution hose 214 and are configured to attach the reinforcing members 218 to the second distribution hose 214. In the illustrated embodiment, the connecting members 220 are spaced apart by a distance in a range of from about 12.0 inches to about 36.0 inches, however, other desired intervals can be used. Advantageously, positioning the connecting members 220 at spaced apart intervals provides the installer with an easy means to gauge the length of the second distribution hose 214 that has been inserted into the wall cavity 206.

Referring now to FIG. 9, the connecting member 220 includes a first aperture 221 configured to receive a portion of the second distribution hose 214. In the illustrated embodiment, the aperture 221 has an inner diameter that is smaller than the outer diameter of the second distribution hose 214, such that the second distribution hose 214 does not move along the length of the second connecting member 220. The connecting member 220 includes a plurality of projections mounts 230, with each of the mounts 230 having an aperture 231. The apertures 231 are configured to receive the reinforcing members 218 and secure the reinforcing members 218 with a friction fit. In this manner, the connecting members 220 are configured to support the second distribution hose 214.

The principle and mode of operation of the loosefill insulation blowing machine have been described in certain embodiments. However, it should be noted that the loosefill insulation blowing machine may be practiced otherwise than as specifically illustrated and described without departing from its scope.

What is claimed is:

1. A machine for distributing loosefill insulation material from a package of compressed loosefill insulation material, the machine comprising:

a chute having an inlet end and an outlet end, the inlet end configured to receive compressed loosefill insulation material;

a lower unit having a shredding chamber configured to receive the compressed loosefill insulation material from the outlet end of the chute, the shredding chamber including a plurality of shredders configured to shred, pick apart and condition the loosefill insulation material;

a discharge mechanism mounted to receive the conditioned loosefill insulation material exiting the shredding chamber, the discharge mechanism configured to distribute the conditioned loosefill insulation material into an airstream;

a blower configured to provide the airstream flowing through the discharge mechanism; and a distribution hose assembly configured to receive the airstream flowing through the discharge mechanism and convey the airstream in a downstream direction, the distribution hose assembly including a distribution hose connected to the machine, a second distribution hose coaxially extending from the distribution hose and a plurality of spaced apart connecting members radially extending from the second distribution hose, the second distribution hose having a length, the plurality of spaced apart connecting members supporting a plurality of continuous reinforcing members spaced apart from the second distribution hose and extending along the length of the second distribution hose.

2. The machine of claim 1, wherein the second distribution hose has a smaller diameter than the distribution hose.

3. The machine of claim 1, distribution hose assembly includes a transition member having a transition angle in a range of from 30° to 40°.

* * * * *